US006540901B2

(12) United States Patent
Mayers et al.

(10) Patent No.: US 6,540,901 B2
(45) Date of Patent: Apr. 1, 2003

(54) PRODUCTION OF SUPPORT FOR LITHOGRAPHIC PRINTING PLATE

(75) Inventors: Felton Rudolph Mayers, Leeds (GB); Tu Vinh Chau, Wackernheim (DE)

(73) Assignee: AGFA-Gevaert, Mortsel (BE)

( * ) Notice: Subject to any disclaimer, the term of this patent is extended or adjusted under 35 U.S.C. 154(b) by 39 days.

(21) Appl. No.: 09/897,241

(22) Filed: Jul. 2, 2001

(65) Prior Publication Data

US 2002/0043168 A1 Apr. 18, 2002

Related U.S. Application Data

(60) Provisional application No. 60/226,755, filed on Aug. 21, 2000.

(30) Foreign Application Priority Data

Jul. 17, 2000 (EP) ..... 00202518

(51) Int. Cl.[7] ..... C25D 5/44; C25D 5/34; C25D 5/48

(52) U.S. Cl. ..... 205/214; 205/205; 205/206; 205/220

(58) Field of Search ..... 428/472.2, 469, 428/409; 101/463.1, 465; 205/205, 220, 324, 219, 214

(56) References Cited

U.S. PATENT DOCUMENTS 3,440,050 A 4/1969 Simon ..... 90/75
4,970,116 A * 11/1990 Kimura et al. ..... 428/332
5,900,345 A * 5/1999 Platzer et al. ..... 430/156

FOREIGN PATENT DOCUMENTS

EP 0 497 351 A 8/1992

OTHER PUBLICATIONS

European Search Report, Application No. EP 00 20 2518, Dec. 20, 2000 = EP 1176031 A1.

* cited by examiner

*Primary Examiner*—Edna Wong
(74) *Attorney, Agent, or Firm*—Joseph T. Guy; Nexsen Pruet Jacobs & Pollard, LLC

(57) ABSTRACT

The present invention provides a process for the manufacture of a substrate for use in the production of lithographic printing plates, the process comprising the steps of:

(a) providing an aluminum substrate;

(b) graining at least one surface of the substrate;

(c) applying an anodic layer to the at least one grained surface;

(d) treating the at least one grained and anodized surface with an aqueous solution comprising at least one salt of a metal from Group IB, IIB, IVA, IVB, VB, VIA, VIB, VIIB or VIII of the Periodic Table; and (e) treating the at least one treated surface with an aqueous solution comprising at least one orthophosphate salt of an alkali metal.

12 Claims, No Drawings

PRODUCTION OF SUPPORT FOR LITHOGRAPHIC PRINTING PLATE

This application claims the benefit of U.S. Provisional application Serial No. 60/226,755 filed Aug. 21, 2000.

This invention relates to a method for the production of a support for use as a substrate for a lithographic printing plate. More specifically, the invention provides a method for the surface treatment of a support material, whereby a substrate having particularly favorable lithographic properties may be obtained.

The material used as the support material depends upon the specific purpose for which the printing plate is to be used and may be, for example, a metal, paper or plastics material. Generally for printing plates, however, the preferred substrate is aluminum, most preferably electrochemically roughened aluminum which includes a surface layer of anodic aluminum oxide. Optionally, said aluminum may be laminated to another metal, such as copper or zinc, or to a plastics material, for example a polyester material such as poly(ethylene terephthalate).

Conventionally, aluminum substrates intended for use as support materials for lithographic printing plates and their precursors have been subjected to surface treatments prior to application of a light sensitive coating material. These treatments serve to improve the lithographic properties of the aluminum, in particular, its hydrophilicity. This is important during printing operations, since the basis of lithography is the ability of the lithographic plate to accept ink in image areas whilst rejecting ink and accepting water in background (non-image) areas, so that the printed image remains free from dirt and other contamination in said background areas. Thus, the light-sensitive coating of a lithographic printing plate precursor is imagewise exposed to radiation in order to change the solubility characteristics of the coating in the radiation-struck areas. The soluble areas are subsequently dissolved away by treatment with a developing solution, to expose the aluminum surface which must be capable of rejecting ink and accepting water.

A typical surface treatment comprises an initial graining treatment, wherein the aluminum surface is roughened by either mechanical or electrochemical means, and a subsequent anodizing treatment, by means of which a layer of aluminum oxide is formed on the surface of the aluminum. Anodizing treatments may, for example, be carried out by passing a grained aluminum web through a bath of a suitable anodizing acid, such as sulfuric or phosphoric acid, or a mixture thereof, whilst an electric current flows through the anodizing bath and the web serves as the anode. The presence of a surface anodic layer greatly enhances the hydrophilicity of the aluminum surface, and the adhesion of the subsequently formed image layer is found to be much improved when the surface of the aluminum is subjected to a graining treatment prior to anodizing.

Additionally, there is generally a requirement for a further surface treatment following the anodizing process. Such a treatment—referred to as a post-anodic dip—is usually applied in order to improve specific lithographic printing properties of the substrate, such as clean up of background areas, coating adhesion or corrosion resistance, and will typically involve treating the aluminum with a solution, often an aqueous solution, of the chosen reagent. Commonly used post-anodic dips include aqueous solutions containing, for example, various inorganic salts or organic derivatives such as poly(acrylic acid) or various aqueous-soluble copolymers.

Thus, EP-A-567178 discloses the treatment of grained and anodized aluminum with an aqueous solution of an alkali metal bicarbonate, whilst the use of solutions containing anions including chloride, fluoride, nitrate, carboxylate, sulfate and phosphate for application to anodized aluminum is described in JP-A-10129143. In addition, GB Patent No 1128506 deals with a process wherein anodized aluminum is treated with an aqueous solution of titanium, zirconium or hafnium tetrachloride—or the corresponding double fluoride formed with, for example, alkali metal fluorides—and subsequently dipped in an aqueous alkaline solution of potassium tetrapyrophosphate. Indeed, the successful use of various fluoride derivatives of titanium, hafnium and zirconium for post-anodic dip treatments has been widely reported; for example, GB Patent No 1504503 teaches the use of potassium titanium fluoride in combination with a vegetable tannin compound and a soluble lithium compound in the treatment of anodized aluminum surfaces in order to improve corrosion resistance, whilst EP-A-178020 discloses a treatment process for otherwise untreated aluminum which provides excellent corrosion resistance and paint adhesion characteristics and involves sequentially contacting the surface with (1) an aqueous acidic solution containing hafnium, zirconium and/or titanium ions, fluoride ions, a tannin compound and a sequestering agent and (2) a solution comprising a polyphenolic compound or acid salt thereof.

The present inventors have found, however, that the use of fluoride derivatives of this type can give rise to problems during the platemaking process, thereby resulting in the production of printing plates of inferior quality. Specifically, it was observed that the ease of performing deletions was adversely affected, such that corrections to the plate surface could only be carried out with difficulty. As a consequence, costly delays were experienced during platemaking, and the vigorous treatments required in order to effect the corrections gave rise to damage to the plate surface, with a resulting deleterious effect on printing performance.

It is, therefore, an object of the present invention to provide a post-anodic dip treatment for grained and anodized aluminum which eliminates the problem of poor ease of deletion during printing platemaking which is associated with the use of fluoride derivatives of titanium, hafnium and zirconium, whilst at the same time retaining the advantageous properties which are associated with the use of these materials.

Initially, the present inventors studied the possible addition of further materials to the post-anodic dip to study their effects in combination with the said fluoride derivatives. Specifically, a series of experiments was carried out with an aqueous solution of potassium hexafluorozirconate to which various other salts had been added; the intention was to examine the potential benefits of several alternative anions in combination with the hexafluorozirconate. It was found that particularly beneficial results were achieved when orthophosphate salts were present in the post-anodic bath, and that the resulting printing plates showed good ease of deletion. Unfortunately, however, severe practical difficulties were associated with this procedure, and the addition of orthophosphate salts to the post-anodic bath in this way was shown to give rise to severe precipitation problems during manufacture, to the extent that the resulting process could not be considered to be commercially viable. Hence, the inventors sought an alternative process, by means of which the beneficial results of the treatment could be maintained, whilst at the same time eliminating the said practical problems.

According to the present invention there is provided a process for the manufacture of a substrate for use in the production of lithographic printing plates, said process comprising the steps of:

(a) providing an aluminum substrate;

(b) graining at least one surface of said substrate;

(c) applying an anodic layer to said at least one grained surface;

(d) treating said at least one grained and anodized surface with an aqueous solution comprising at least one salt of a metal from Group IB, IIB, IVA, IVB, VB, VIA, VIB, VIIB or VIII of the Periodic Table; and (e) treating said at least one treated surface with an aqueous solution comprising at least one orthophosphate salt of an alkali metal.

Said treatment of said at least one grained and anodized surface with an aqueous solution comprising at least one salt of a metal from Group IB, IIB, IVA, IVB, VB, VIA, VIB, VIIB or VIII of the Periodic Table is preferably carried out by treating said substrate with an aqueous solution, preferably containing from 0.01% to 10.0% (w/w) (more preferably from 0.05% to 1.5%) of said salt at a preferred temperature of from 10° to 90° C. (more preferably from 40° to 80° C.) for a preferred dwell time of from 0.1 second to 5 minutes (more preferably from 0.2 second to 30 seconds) at a pH which preferably lies between 1 and 6, most preferably between 3.5 and 5.5. Various coating techniques may be employed for application of the salt, such as dip coating, slot coating, reverse roll coating or electrochemical coating; most preferred, however, is spray coating. Single pass processes are also preferred since they facilitate the avoidance of contamination which could otherwise occur as a consequence of re-circulation of the solution.

Suitable salts which may be used for the said treatment include, for example, salts of titanium, zirconium, hafnium, molybdenum, tungsten, vanadium, manganese, nickel, copper, zinc, tin, niobium, tantalum, cerium, selenium, silicon, cobalt or iron. Said salts may include the metal either as the cation, for example in halide, sulfate or nitrate salts, or as part of a complexed anion. Particularly favorable results are achieved with salts of titanium, zirconium or hafnium, such as hafnium sulfate, zirconium phosphate, titanium nitrate, hafnium acetate, zirconium fluoride and titanium chloride. Most preferably, however, the hafnium, zirconium or titanium salt comprises a salt wherein the metal is present in a metal-complex anion, such as a chlorotitanate or fluorozirconate anion. Especially preferred in this regard are the alkali metal fluorozirconates, particularly potassium hexafluorozirconate.

Said treatment of at least one treated surface with an aqueous solution comprising at least one orthophosphate salt of an alkali metal is preferably carried out by treating said substrate with an aqueous solution, preferably containing from 0.01% to 10.0% (w/w) (more preferably from 0.05% to 1.5%) of an orthophosphate salt of an alkali metal at a preferred temperature of from 5° to 90° C. (more preferably from 40° to 80° C.) for a preferred dwell time of from 0.05 second to 5 minutes (more preferably from 0.1 second to 30 seconds) at a pH which preferably lies between 3 and 7, most preferably around 4.5. Various coating techniques may be employed for application of the orthophosphate salt of an alkali metal, such as dip coating, slot coating, reverse roll coating or electrochemical coating; most preferred, however, is spray coating. Single pass processes are also preferred since they facilitate the avoidance of contamination which could otherwise occur as a consequence of re-circulation of the solution.

Particularly suitable orthophosphate salts of alkali metals which may be used for the said treatment are the orthophosphates of sodium or potassium, including the hydrogen and dihydrogen orthophosphates. It has been found that these materials provide superior results, and are therefore preferred. Other phosphorus-containing compounds, such as hypophosphonate, hypophosphate, pyrophosphonate, pyrophosphate, phosphonate, polyphosphonate or metaphosphonate derivatives have been reported in the prior art, but generally provide printing plates of lower quality than those obtained by the application of orthophosphate salts.

In addition, the use of alkali metal fluorophosphates or difluorophosphates, phosphosilicates and phosphoborates, all of which facilitate the controlled release of phosphate into the coating bath, and various organic materials, such as the copolymer of acrylic acid and vinyl phosphonic acid, has been investigated. However, from an economic viewpoint, the cheaper orthophosphates are the most preferred materials, giving excellent performance at optimum cost, with sodium dihydrogen orthophosphate and, most particularly, potassium dihydrogen orthophosphate being especially preferred.

The orthophosphate salt of an alkali metal may be applied to the substrate simultaneously with the salt of a metal from Group IB, IIB, IVA, IVB, VB, VIA, VIB, VIIB or VIII of the Periodic Table, or it may be applied in a separate treatment, subsequent to the application of the said salt; in either case, plates showing excellent ease of deletion, as well as other desirable properties, are obtained. However, precipitation problems which are associated with the simultaneous treatment method are not apparent when the treatments are carried out as separate stages, with the orthophosphate salt of an alkali metal being applied subsequent to the treatment with the salt of a metal from Group IB, IIB, IVA, IVB, VB, VIA, VIB, VIIB or VIII of the Periodic Table.

Additionally, other materials may be incorporated in the aqueous solution of the salt of a metal from Group IB, IIB, IVA, IVB, VB, VIA, VIB, VIIB or VIII of the Periodic Table, or the aqueous solution of at least one orthophosphate salt of an alkali metal—or the combined solution, if this is to be employed. Specifically, the solution or solutions may include materials such as sequestering agents, tannin, sulfuric acid, fluorides and other additives which are known to improve the lithographic properties of a substrate, including various organic and inorganic polymeric materials.

Optionally, said substrate may be rinsed with water following said treatment with an aqueous solution comprising at least one salt of a metal from Group IB, IIB, IVA, IVB, VB, VIA, VIB, VIIB or VIII of the Periodic Table, and prior to said treatment with an aqueous solution comprising at least one orthophosphate salt of an alkali metal.

Said aluminum substrate may comprises pure aluminum or an aluminum alloy containing small amounts of, for example, manganese, nickel, cobalt, zinc, iron, copper, magnesium, titanium, vanadium, silicon or zirconium. Said substrate is generally provided in the form of a continuous web or roll of material.

Preferably, said substrate is subjected to a degreasing treatment prior to said graining treatment. Said degreasing treatment is most conveniently carried out by means of an aqueous alkaline solution. Typically, said treatment involves passing said substrate through a bath containing a 1–20% w/v solution of, for example, sodium or potassium hydroxide at a temperature of 30–80° C. for a dwell time of from 5–60 seconds. Following said degreasing treatment, said substrate is rinsed with water prior to further treatment.

Any of the known techniques may be utilized for graining the substrate. Said graining treatment can involve mechanical graining, wherein the surface of the substrate is subjected to mechanical forces which may, for example, be achieved by the use of a slurry of very small metal balls or via brush graining techniques. Alternatively, and most preferably, electrochemical graining may be employed; said technique typically comprises passing a substrate through a solution of a mineral or organic acid, or a mixture thereof, such as a mixture of hydrochloric and acetic acids, whilst applying an electric current to the acid solution. Alternatively, solutions of suitable inorganic salts in mineral acids are also found to provide highly acceptable results; particularly favored in this respect is a mixed electrolyte comprising hydrochloric acid, hydrated aluminum chloride and hydrated aluminum sulfate. By way of illustration, suitable graining conditions could involve the use of a bath of aqueous hydrochloric acid at a concentration of from 1–30 g/l and a temperature of 5–70° C., with a dwell time of from 1–60 seconds at a charge density of 200–800 C/dm$^2$ and an applied potential of from 1–60 V. The grained substrate is then rinsed with water prior to further processing.

Following electrochemical graining, said grained substrate should be subjected to a desmutting treatment in order to remove by-products formed during the course of said electrograining treatment, and deposited on the surface of the substrate. Typically, the process involves treatment of the grained substrate with an aqueous acid or alkali according to the methods well known in the art. Suitable desmutting conditions could, for example, involve treatment of the grained substrate with aqueous phosphoric acid at a concentration of around 20–400 g/l at a temperature in the region of 20–80° C. for a dwell time of the order of 1 second to 5 minutes; alternatively, a higher temperature treatment—using sulfuric acid at 50–300 g/l and 30–80° C. for a shorter dwell time of around 8 seconds—may be employed, or an alkaline treatment, with 2–20 g/l aqueous sodium hydroxide at 5–60° C., would suffice. The substrate is rinsed with water following desmutting.

Anodizing of the grained substrate is carried out by means of any of the standard techniques well known in the art, and typically involves passing the substrate through a bath containing an aqueous mineral acid, such as sulfuric, phosphoric, nitric, hydrofluoric or chromic acid, or an aqueous solution of an organic acid, for example oxalic, tartaric, citric, acetic or oleic acid, or a mixture of these acids, whilst applying an electric current to the anodizing bath. Suitable anodizing conditions would involve the use of a bath of sulfuric acid at a concentration of from 10 to 300 g/l, preferably 100–150 g/l, and a temperature in the range of from 20–60° C., preferably 40–60° C., with a dwell time of from 1 to 120 seconds, preferably 3 to 40 seconds, an applied potential of from 5–60 V, preferably 10–50 V, and a charge density of from 100–500 C/dm$^2$, preferably 200–400 C/dm$^2$. The grained and anodized substrate is then rinsed with water prior to further processing.

The process provided by the present invention may be successfully employed using various forms of process and coating technology. Principally, said process is suitable for use with the different forms of cell alignment associated with flat bed technology and vertical cell technology, both of which are well known to those skilled in the art.

The support provided by the method of the present invention may subsequently be coated with a light-sensitive coating to give a lithographic printing plate precursor. Various coatings of the types well known to those skilled in the art may be applied for this purpose, for example, positive-working coatings incorporating quinone diazide derivatives, negative-working coatings incorporating diazo or azide resins or photocrosslinkable resins or silver halide based coatings. The coatings may be applied by any of the standard coating techniques known to the skilled person, such as curtain coating, dip coating, meniscus coating, slot coating, reverse roll coating, and the like.

The thus-obtained lithographic printing plate precursor may then be imagewise exposed and the non-image areas can be developed away to provide a lithographic printing plate which is subsequently used on a printing press to produce copies.

Lithographic printing plates produced from aluminum supports obtained by the method of the present invention show excellent performance in terms of ease of deletion, as well as good corrosion resistance, solvent resistance, clean up and roll-up on press. No background staining is observed and plates exhibit excellent ink-water balance and damping latitude performance, as well as good run length.

The invention will now be illustrated, though without limitation, by reference to the following examples:

EXAMPLES

Example 1

An aluminum alloy substrate comprising Al ≧99.1%, Si ≦0.2%, Fe ≦0.4%, Cu ≦0.05%, Mn ≦0.05%, Mg ≦0.05%, Zn ≦0.07%, Ti ≦0.05% and V ≦0.05% was conventionally degreased, rinsed and subjected to an electrochemical graining treatment using a liquor comprising hydrochloric acid (9 g/l) and acetic acid (25 g/l) at a temperature of 30° C. for a dwell time of 20 seconds at a charge density of 500 C/dm$^2$. Following water rinsing and desmutting in a solution of phosphoric acid (260 g/l) at 45° C. for 20 seconds, the grained substrate was subjected to an anodizing process by treating with sulfuric acid (145 g/l) at 45° C. for a dwell time of 20 seconds at a charge density of 250 C/dm$^2$, then rinsed with water.

The grained and anodized aluminum substrate was then treated by spray coating for 20 seconds with an aqueous solution of potassium hexafluorozirconate (5 g/l) having pH 4.0 at 60° C., then spray coated with an aqueous solution of potassium dihydrogen orthophosphate (12 g/l) having pH 4.5 at 60° C. for 20 seconds. No evidence of precipitation was observed during, or subsequent to, either treatment.

The resulting substrate was rinsed with water and coated with a solution of a naphthoquinone diazide photosensitive resin and a cresol novolak support resin in 2-methoxypropanol to produce a light-sensitive coating layer, and the coated substrate was baked at 130° C. for 5 minutes. The resulting lithographic printing plate precursor was imagewise exposed to UV light at 100–300 mJ/cm$^2$ and the non-image areas were developed away with an aqueous alkaline developer solution by immersion for 30 seconds at 20° C. The resulting lithographic printing plate was rinsed with water and dried in a stream of cool air and subsequently produced 250,000 excellent quality copies on a Drent Web Offset press. The plate showed excellent roll-up and clean up, with no background staining, on press. Ink/water balance, damping latitude and solvent resistance were also all exceptionally good. On treatment with Posidel A (a commercial deletion fluid supplied by Agfa-Gevaert) the plate showed excellent ease of deletion and little evidence of residual staining.

Example 2

An aluminum alloy substrate comprising Al ≧98.0%, Si ≦0.5%, Fe ≦0.7%, Cu ≦0.05%, Mn 1.0–1.5%, Mg ≦0.15%, Zn ≦0.1%, Ti ≦0.05% and V ≦0.05% was degreased, grained, desmutted and anodized as described in Example 1.

The grained and anodized aluminum substrate was then treated by spray coating for a dwell time of 3.5 seconds with an aqueous solution of potassium hexafluorozirconate (5 g/l) having pH 4.0 at 80° C., then further spray coated with an aqueous solution of potassium dihydrogen orthophosphate (8 g/l) having pH 4.5 at 70° C. for 0.5 second. No evidence of precipitation was observed during, or subsequent to, either treatment.

The resulting substrate was rinsed with water and coated with a solution of a naphthoquinone diazide photosensitive resin and a cresol novolak support resin in 2-methoxypropanol and tetrahydrofuran (1:1) which contained dispersed particles of silica having an average diameter of approximately 4 $\mu$M. The coated substrate was baked at 140° C. for 30 seconds to 1 minute to produce a light-sensitive coating layer having a mat surface layer which promoted good vacuum drawdown performance during imagewise exposure. This was carried out using UV light at 100–300 mJ/cm$^2$, after which the non-image areas were developed away with an aqueous alkaline developer solution by immersion for 30 seconds at 20° C. The resulting lithographic printing plate was rinsed with water and dried in a stream of cool air and subsequently produced 250,000 excellent quality copies on a Drent Web Offset press. The plate showed excellent roll-up and clean-up, with no background staining, on press. Ink/water balance, damping latitude and solvent resistance were also all exceptionally good. On treatment with Posidel A (a commercial deletion fluid supplied by Agfa-Gevaert) the plate showed excellent ease of deletion and little evidence of residual staining.

Example 3

An aluminum alloy substrate as in Example 1 was conventionally degreased, rinsed and subjected to an electrochemical graining treatment using a liquor comprising hydrochloric acid (12 g/l) and sulfuric acid (9 g/l) at a temperature of 40° C. for a dwell time of 5 seconds at a charge density of 540–550 C/dm$^2$. Following water rinsing and desmutting in sulfuric acid (145 g/l) at 70° C., the grained substrate was subjected to an anodizing process by treating with sulfuric acid (145 g/l) at 57° C. for a dwell time of 6 seconds at a charge density of 250 C/dm$^2$, then rinsed with water.

The grained and anodized aluminum substrate was slot coated for 5 seconds with an aqueous solution of potassium hexafluorozirconate (5 g/l) having pH 4.0 at 70° C., then further treated by slot coating with an aqueous solution of potassium dihydrogen orthophosphate (4 g/l) having pH 4.5 at 70° C. for 1.0 second. No evidence of precipitation was observed during, or subsequent to, either treatment.

The resulting substrate was rinsed with water and coated with a solution of a naphthoquinone diazide photosensitive resin and a cresol novolak support resin in 2-methoxypropanol to produce a light-sensitive coating layer, and the coated substrate was baked at 130° C. for 5 minutes. The resulting lithographic printing plate precursor was imagewise exposed to UV light at 100–300 mJ/cm$^2$ and the non-image areas were developed away with an aqueous alkaline developer solution by immersion for 30 seconds at 20° C. The resulting lithographic printing plate was rinsed with water and dried in a stream of cool air and subsequently produced 250,000 excellent quality copies on a Drent Web Offset press. The plate showed excellent roll-up and clean-up, with no background staining, on press. Ink/water balance, damping latitude and solvent resistance were also all exceptionally good. On treatment with Posidel A (a commercial deletion fluid supplied by Agfa-Gevaert) the plate showed excellent ease of deletion and little evidence of residual staining.

Example 4

An aluminum alloy substrate was degreased, grained, desmutted and anodized as described in Example 1.

The grained and anodized aluminum substrate was then treated by spray coating for a dwell time of 3.5 seconds with an aqueous solution of sodium hexachlorotitanate (5 g/l) having pH 4.0 at 80° C., then further spray coated with an aqueous solution of sodium dihydrogen orthophosphate (8 g/l) having pH 4.5 at 70° C. for 0.5 second. No evidence of precipitation was observed during, or subsequent to, either treatment.

The resulting substrate was rinsed with water and coated with a solution of a naphthoquinone diazide photosensitive resin and a cresol novolak support resin in 2-methoxypropanol to produce a light-sensitive coating layer, and the coated substrate was baked at 130° C. for 5 minutes. The resulting lithographic printing plate precursor was imagewise exposed to UV light at 100–300 mJ/cm$^2$ and the non-image areas were developed away with an aqueous alkaline developer solution by immersion for 30 seconds at 20° C. The resulting lithographic printing plate was rinsed with water and dried in a stream of cool air and subsequently produced 250,000 excellent quality copies on a Drent Web Offset press. The plate showed excellent roll-up and clean-up, with no background staining, on press. Ink/water balance, damping latitude and solvent resistance were also all exceptionally good. On treatment with Posidel A (a commercial deletion fluid supplied by Agfa-Gevaert) the plate showed excellent ease of deletion and little evidence of residual staining.

Comparative Example 1

An aluminum alloy substrate was degreased, grained, desmutted and anodized as described in Example 1.

The grained and anodized aluminum substrate was treated for 20 seconds with an aqueous solution of potassium hexafluorozirconate (5 g/l) and poly(vinyl phosphonic acid) (2 g/l) having pH 4.0 at 60° C. No evidence of precipitation was observed during, or subsequent to, the said treatment.

The resulting substrate was rinsed with water and coated with a solution of a naphthoquinone diazide photosensitive resin and a cresol novolak support resin in 2-methoxypropanol to produce a light-sensitive coating layer, and the coated substrate was baked at 130° C. for 5 minutes. The resulting lithographic printing plate precursor was imagewise exposed to UV light at 100–300 mJ/cm$^2$ and the non-image areas were developed away with an aqueous alkaline developer solution by immersion for 30 seconds at 20° C. The resulting lithographic printing plate was rinsed with water and dried in a stream of cool air and subsequently produced 250,000 excellent quality copies on a Drent Web Offset press. The plate showed excellent roll-up and clean-up, with no background staining, on press. Ink/water balance, damping latitude and solvent resistance were also all exceptionally good. On treatment with Posidel A (a commercial deletion fluid supplied by Agfa-Gevaert) the plate showed moderate ease of deletion and evidence of residual staining was observed.

Comparative Example 2

An aluminum alloy substrate was degreased, grained, desmutted and anodized as described in Example 1.

After rinsing with water, the grained and anodized aluminum substrate was spray coated for 20 seconds with an aqueous solution of potassium hexafluorozirconate (5 g/l) having pH 4.0 at 60° C., then treated with an aqueous solution of a poly(vinyl phosphonic acid) (2 g/l) having pH 3.5 by spray coating at 60° C. for 20 seconds. No evidence of precipitation was observed during, or subsequent to, either treatment.

The resulting substrate was rinsed with water and coated with a solution of a naphthoquinone diazide photosensitive resin and a cresol novolak support resin in 2-methoxypropanol to produce a light-sensitive coating layer, and the coated substrate was baked at 130° C. for 5 minutes. The resulting lithographic printing plate precursor was imagewise exposed to UV light at 100–300 mJ/cm$^2$ and the non-image areas were developed away with an aqueous alkaline developer solution by immersion for 30 seconds at 20° C. The resulting lithographic printing plate was rinsed with water and dried in a stream of cool air and subsequently produced 250,000 excellent quality copies on a Drent Web Offset press. The plate showed excellent roll-up and clean-up, with no background staining, on press; ink/water balance and damping latitude were also very good. On treatment with Posidel A (a commercial deletion fluid supplied by Agfa-Gevaert) the plate showed excellent ease of deletion and little evidence of residual staining. However, in terms of solvent resistance and corrosion resistance, the performance was poor.

Comparative Example 3

An aluminum alloy substrate was degreased, grained, desmutted and anodized as described in Example 1.

The grained and anodized aluminum substrate was treated for 20 seconds with an aqueous solution of potassium hexafluorozirconate (5 g/l) and sodium pyrophosphate (8 g/l) having pH 4.0 at 60° C. No evidence of precipitation was observed during, or subsequent to, the said treatment.

The resulting substrate was rinsed with water and coated with a solution of a naphthoquinone diazide photosensitive resin and a cresol novolak support resin in 2-methoxypropanol to produce a light-sensitive coating layer, and the coated substrate was baked at 130° C. for 5 minutes. The resulting lithographic printing plate precursor was imagewise exposed to UV light at 100–300 mJ/cm$^2$ and the non-image areas were developed away with an aqueous alkaline developer solution by immersion for 30 seconds at 20° C. The resulting lithographic printing plate was rinsed with water and dried in a stream of cool air and subsequently produced 250,000 excellent quality copies on a Drent Web Offset press. The plate showed excellent roll-up and clean-up, with no background staining, on press. Ink/water balance, damping latitude and solvent resistance were also all exceptionally good. On treatment with Posidel A (a commercial deletion fluid supplied by Agfa-Gevaert) the plate showed excellent ease of deletion and little evidence of residual staining.

What is claimed is:

1. A process for the manufacture of a substrate for use in the production of lithographic printing plates, said process comprising the steps of:

(a) providing an aluminum substrate;

(b) graining at least one surface of said substrate;

(c) applying an anodic layer to said at least one grained surface;

(d) treating said at least one grained and anodized surface with an aqueous solution comprising at least one salt of a metal from Group IB, IIB, IVA, IVB, VB, VIA, VIB, VIIB or VIII of the Periodic Table; and (e) treating said at least one treated surface with an aqueous solution comprising at least one orthophosphate salt of an alkali metal.

2. A process as defined in claim 1 wherein said orthophosphate salt of an alkali metal comprises trisodium orthophosphate, disodium hydrogen orthophosphate, sodium dihydrogen orthophosphate, tripotassium orthophosphate, dipotassium hydrogen orthophosphate or potassium dihydrogen orthophosphate.

3. A process as defined in claim 1 wherein said salt of a metal from Group IB, IIB, IVA, IVB, VB, VIA, VIB, VIIB or VIII of the Periodic Table comprises a salt of titanium, zirconium, hafnium, molybdenum, tungsten, vanadium, manganese, nickel, copper, zinc, tin, niobium, tantalum, cerium, selenium, silicon, cobalt or iron.

4. A process as defined in claim 1 wherein said salt of a metal from Group IB, IIB, IVA, IVB, VB, VIA, VIB, VIIB or VIII of the Periodic Table includes the metal as the cation.

5. A process as defined in claim 4 wherein said salt comprises a sulfate, phosphate, nitrate, acetate, fluoride or chloride salt of titanium, zirconium or hafnium.

6. A process as defined in claim 1 wherein said salt of a metal from Group IB, IIB, IVA, IVB, VB, VIA, VIB, VIIB or VIII of the Periodic Table includes the metal as part of a complexed anion.

7. A process as defined in claim 6 wherein said salt comprises an alkali metal fluorozirconate.

8. A process as defined in claim 7 wherein said alkali metal fluorozirconate comprises potassium hexafluorozirconate.

9. A process as defined in claim 1 wherein said aluminum substrate comprises aluminum or an aluminum alloy containing small amounts of at least one of manganese, nickel, cobalt, zinc, iron, copper, magnesium, titanium, vanadium, silicon or zirconium.

10. A process as defined in claim 1 wherein said graining step comprises a mechanical or electrochemical graining treatment.

11. A process as defined in claim 10 wherein said electrochemical graining treatment comprises passing a substrate through a solution of a mineral or organic acid, or a mixture thereof, whilst applying an electric current to the acid solution.

12. A process as defined in claim 1 wherein said anodic layer is applied to said at least one grained surface of the substrate by passing said substrate through an aqueous mineral or organic acid, or a mixture thereof, whilst applying an electric current to the acid solution.

* * * * *